United States Patent [19]

Foote

[11] Patent Number: 5,067,874

[45] Date of Patent: Nov. 26, 1991

[54] COMPRESSIVE SEAL AND PRESSURE CONTROL ARRANGEMENTS FOR DOWNHOLE TOOLS

[75] Inventor: Dean Foote, Edmonton, Canada

[73] Assignee: Computalog Ltd., Edmonton, Canada

[21] Appl. No.: 508,974

[22] Filed: Apr. 13, 1990

[30] Foreign Application Priority Data

Apr. 14, 1989 [CA] Canada ..... 596698

[51] Int. Cl.[5] ..... F16J 15/40

[52] U.S. Cl. ..... 415/230; 415/903; 277/3

[58] Field of Search ..... 415/903, 229, 230, 231, 415/110, 111, 112–113; 277/3, 5, 6, 30; 175/107

[56] References Cited

U.S. PATENT DOCUMENTS

| | | | |
|---|---|---|---|
| 2,710,205 | 6/1955 | Brkich | 277/3 |
| 2,800,296 | 7/1957 | Hatch et al. | 175/107 |
| 3,169,776 | 2/1965 | Felt . | |
| 3,297,331 | 1/1967 | Tracy . | |
| 3,342,500 | 9/1967 | Knudson . | |
| 3,363,910 | 1/1968 | Toronchuk . | |
| 3,749,511 | 7/1973 | Mayall | 415/903 |
| 3,971,450 | 7/1976 | Fox | 415/903 |
| 4,256,189 | 3/1981 | Fox et al. | 175/107 |
| 4,299,398 | 11/1981 | Wahl | 277/3 |
| 4,307,889 | 12/1981 | Piazza | 175/107 |
| 4,381,867 | 5/1983 | Ohgoshi | 277/27 |
| 4,421,323 | 12/1983 | Burke . | |
| 4,453,604 | 6/1984 | Ioanesian et al. | 415/903 |
| 4,473,231 | 9/1984 | Tilton et al. . | |
| 4,496,161 | 1/1985 | Fischer . | |
| 4,506,736 | 3/1985 | Evans . | |

*Primary Examiner*—Edward K. Look
*Assistant Examiner*—James A. Larson
*Attorney, Agent, or Firm*—Robert W. Becker & Associates

[57] ABSTRACT

The disclosure relates to downhole drilling motors which include seal arrangements and pressure control assemblies for staging the pressure between the two seal assemblies, with each pressure control assembly including a rotary element for displacing a piston, and the piston controlling one or several valves.

3 Claims, 5 Drawing Sheets

1
2
3
6
4
5
7
11
18
14
16
10
15
10
13
15
17
18
18
8
17
9
8

COMPRESSIVE SEAL AND PRESSURE CONTROL ARRANGEMENTS FOR DOWNHOLE TOOLS

BACKGROUND OF THE INVENTION

1. Field of the Invention

This invention relates to a seal and pressure control arrangement, and more particularly to a compressive seal and actuating arrangement employed in downhole tools for oil well equipment, such as downhole drilling motors to rotate the drilling bit or bits.

The arrangements of the present invention are intended for a drill string in which drilling mud or fluid (a liquid slurry) is passed under pressure from the inlet down to the drill elements of the drill string.

2. Description of the Prior Art

It is well known that effective cleaning of the drilled surface of the bore-hole by high pressure jetting of the drilling fluid increases both penetration rate and drill bit life.

This practice, however, poses major concerns in drilling motors due to the pressure differential created by these jets. Specifically, in oil-lubricated motors, the attendant seals that must withstand such pressure conditions often limit the extent to which this technique may be employed.

The solution, to date, ends with a compromise between the pressure drop experienced across the drill bit and the serviceable life of the motor, i.e., an increase in pressure will lead to a reduced serviceable life of the respective motor. Oil-lubricated drilling motors specify a maximum pressure drop across the bit of approximate 3447.5 Kpa (500 psi). Nowadays, frequently requested, and commonly preferred, however, are pressures in excess of 6895 Kpa (1000 psi), but with present technology and practice, pursuit of more effective jetting of the drilling mud frequently leads to expensive and premature failure of such motors.

Research to date has concentrated on the provision of complicated "super seals" in attempts to obviate the mentioned problems. Most of these are often expensive and generally tend to be unreliable.

According to U.S. Pat. No. 3,169,776-Felt dated Feb. 16, 1965, in machinery including a bore and a central member disposed within said bore and spaced therefrom to define an annular cavity of a transverse cross-section width W about a central member, a resilient packing-ring is disposed. The packing-ring comprises a packing-ring member including an upper surface and having a cross-section having a base portion of width less than W and an upper, deformable, bifurcated portion constructed to delineate an annular recessed area of undercut character which is contiguous with and medially depends from said upper surface and which is conformable to an O-ring snap-seated therein. The O-ring can be snap-seated in the annular recessed area to be protruding above said upper surface. The packing-ring and the O-ring have respective slit interruptions which are mutually displaced.

U.S. Pat. No. 3,297,331-Tracy dated Jan. 10, 1967 shows, for use in an assembly for sealing a rotating shaft within a housing, an articulated spring-holder assembly including an expander ring adapted to engage a seal, said ring being subject to force of a helical spring; a housing encloses the helical spring; and means for articulately connecting the expander ring to said housing so that said seal assembly accommodates vibration, misalignment and run-out.

U.S. Pat. No. 3,342,500-Knudson dated Sept. 19, 1967 is concerned with a composite packing comprising a deformable substantially non-compressible elongated packing member having in transverse cross-section, a base of width W from which extends a bifurcated portion defined by spaced apart legs forming a groove for receiving an O-shaped member, with the surfaces of said legs adjacent the edges of said groove being formed to flare outwardly from a tangential intersection with the inner surfaces of said legs. A deformable substantially non-compressible O-shaped member of a diameter less than said packing member can be snap-seated in said groove in surface contact with the inner surfaces of said legs and normally holds said bifurcated portion spread to a width greater than W. The O-shaped member has a diameter exceeding the length of said legs whereby a portion of said O-shaped member extends from said groove.

U.S. Pat. No. 3,363,910-Toronchuk dated Jan. 16, 1968 relates to a shaft seal for a high pressure pump having a stationary seal member capable of limiting axial and tilting movement and having a rotary sealing member with an inner cylindrical surface spaced from the shaft and an annular member on the shaft projecting outwards with a sealing ring at its apex engaging the inner cylindrical surface on the rotary sealing member. This permits the rotary sealing member to move longitudinally and to tilt with respect to the shaft.

U.S. Pat. No. 4,381,867-Ohgoshi dated May 3, 1983 also relates to a mechanical seal made in a unit construction in which a seal unit case is fitted into and held by the inner periphery of a seal housing in a non-rotatable but axially slidable manner. In the seal housing there is disposed a rotary ring provided on a rotary shaft in a non-rotatable but axially slidable manner. A stationary ring in contact with the rotary ring at the sealing end surfaces thereof is securely fixed to the seal housing. The mechanical seal can be automatically moved to a position where a first fluid and a second fluid are balanced in pressure in response to a difference in pressure between these two fluids.

According to U.S. Pat. No. 4,421,323-Lipschitz dated Dec. 20, 1983, an oil well string member has a cylindrical outer periphery having first and second cylindrical surfaces axially spaced and connected as a tapered ramp. The surfaces are radially inwardly of the outer periphery. The first surface has a smaller diameter than the second surface. A seal assembly is provided along the first surface and arranged to respond to fluid pressure for moving the assembly across the ramp to the second surface and into a sealing position.

U.S. Pat. No. 4,473,231-Tilton et al dated Sept. 25, 1984 shows an arrangement for use in establishing dynamic sealing integrity between a tubular conduit, such as a tubing string, and an in-place tubular seal receptacle, such as a packer, bridge plug or expansion joint, which arrangement includes a multi-unit, multi-element seal assembly. The seal assembly comprises a plurality of seal units with seal units oriented in opposite directions to hold pressure from both ends of the seal stack. The various elements and units of the seal stack are assembled on the exterior of the tubular conduit prior to insertion of the seal stack into the well. Each separate seal unit comprises at least a primary sealing element having a V-shaped cross-section with opposed concave and convex ends and at least one adjacent backup member having a convex surface of the primary elastomeric sealing element. The backup member comprises means for closing off the annular extrusion gap along the bore of the outer seal receptacle. The V-shaped sealing element has a coefficient of expansion greater than the coefficient of expansion of the backup member. The backup member, however, does expand to close off or reduce the extrusion gap along the seal receptacle bore and therefore prevents loss of primary sealing material through the annular sealing gap. The angle defined by inner and outer surfaces on the convex end of the backup member is acute and is normally less than the angle defined by inner and outer surfaces on the concave end of the primary sealing member. Thus when the individual seal units are assembled, the inner and outer surfaces on the concave end of the primary sealing member are not in contact with the inner and outer surfaces on the concave end of the adjacent annular backup member. The primary sealing element is therefore free to flex radially and to expand inwardly and outwardly along the concave end of the V-shaped member.

U.S. Pat. No. 4,496,161-Fischer dated Jan. 29, 1985 is concerned with a radially extensible joint packing with an O-ring assembly having a generally piston-like shape elastomeric body that is radially extensible and has a circumferential groove which retains a circumferentially extensible O-ring.

U.S. Pat. No. 4,506,736-Evans dated Mar. 26, 1985 shows a seal assembly for use in an oil well packer of the type having a packer body having a longitudinal bore, a packer carried on the body for sealing off the annular space between the body and a surrounding well conduit, a mandrel slidably disposed within the body longitudinal bore, the mandrel being spaced-apart from the body to define a fluid flow path between the mandrel exterior and the interior of the body, and wherein the mandrel is slidable between an open, running-in position in which the fluid flow path communicates the annular space above the packer with the mandrel longitudinal passageway and a closed, set position in which the fluid flow path is sealed off. The improvement includes a face seal housing as a part of the mandrel which has a weight loading shoulder and a deformable seal portion. The weight loading shoulder is in the closed, set position to thereby support the weight of the mandrel from the body. A pressure biased seal body for contacting the deformable seal portion when the mandrel is in the closed, set-position to seal off the fluid flow path.

It is known that common sealing elements have certain limitations in high pressure, rotary applications. There exists a point at which pressure and velocity of the respective rotating surfaces combine to generate sufficient heat to cause the sealing elements to fail; the primary source of heat being friction, is dramatically increased by both pressure and velocity.

SUMMARY OF THE INVENTION

An object of the present invention is to substantially alleviate these limitations and to place a number of seals in series in order to accommodate the total pressure in small steps or stages. This technique will allow control of the magnitude of pressure exerted on any individual sealing element throughout the motor. For example, seals of larger diameter will experience a higher surface velocity at a given constant rpm than smaller diameter seals at the same rpm. Therefore, in accord with the present inventive technique and bearing in mind that both the magnitude of pressure and velocity contribute to seal failure, it is now possible to compensate a high velocity with lower pressure on a given seal or sealing element thereof.

In accordance with a further object of the invention there is provided a downhole drilling motor, including a seal arrangement having at least one compressible element to effect a higher sealing action; and at least one pressure control arrangement including at least one valve.

Included in the objects of the present invention are:

To provide a seal and pressure control arrangement exhibiting a longer seal life at pressures greater than hitherto known in the art.

To preclude the seal from causing damage to the surface of the rotating member.

BRIEF DESCRIPTION OF THE DRAWINGS

This and further objects and advantages of the invention will become more readily apparent from the following detailed description taken in conjunction with the accompanying drawings in which.

DETAILED DESCRIPTION

Figures 1, 2:
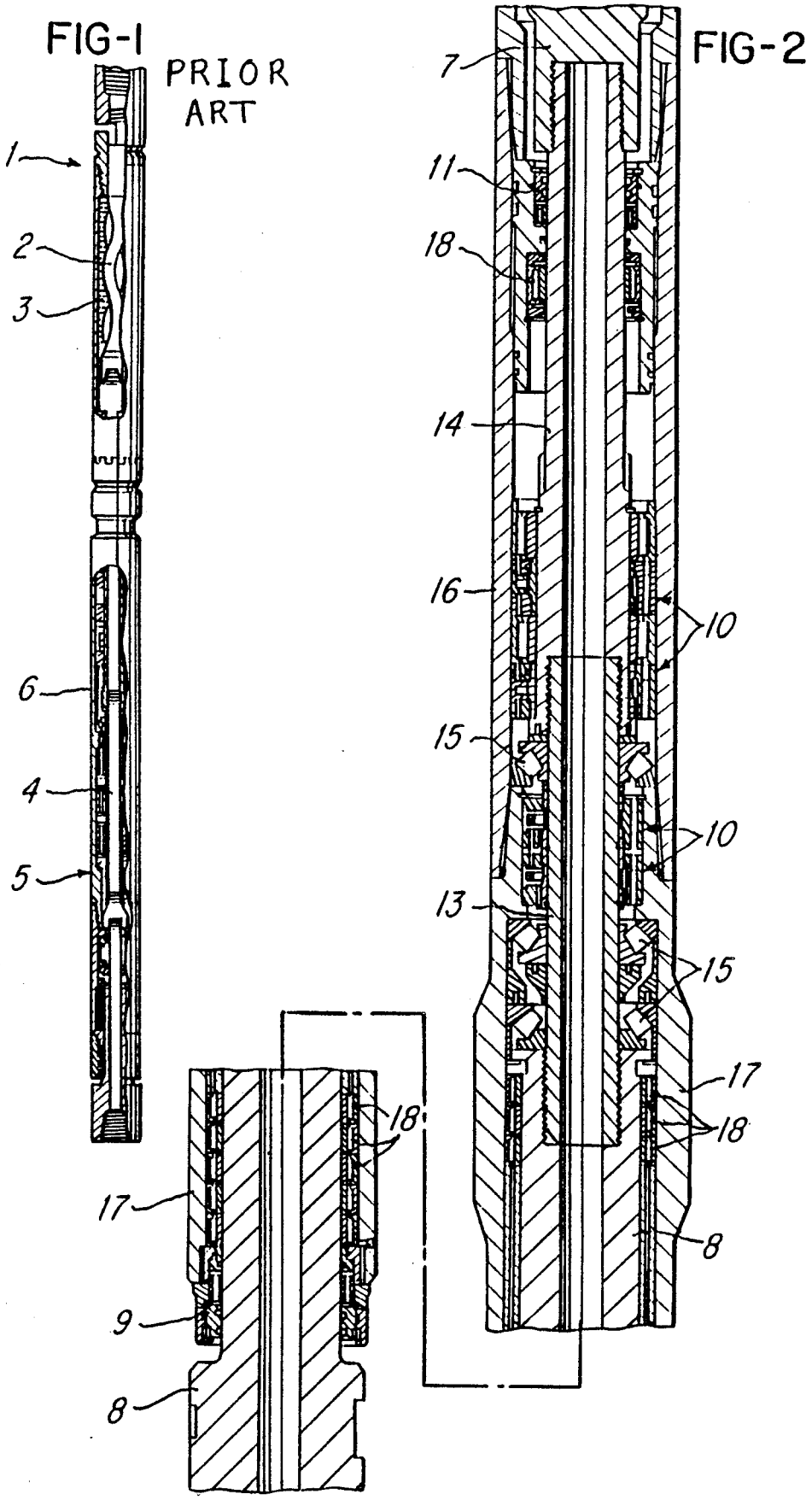
FIG-1 PRIOR ART
FIG. 1 is a schematic view of a conventional downhole drilling motor.
FIG. 2 is a cross-sectional view of the seal and pressure control arrangement according to the invention.

FIG. 1 shows the general arrangement of a drilling motor generally identified by reference numeral 1 and which is of the oil-lubricated and pressure compensated bearing type, which includes a helical shaft 2 to impart torque from the drilling mud generally identified by reference numeral 3 to the drill bit or bits (not shown).

The drilling mud or fluid 3 is passed through the central pipe 4 and then to the drill elements, not shown, in a customary manner.

The speed reducer section of the assembly is generally designated by the reference numeral 5, and the associated stationary housing is generally identified by reference numeral 6.

With reference to FIG. 2, the drilling mud 3 is passed from a U-joint assembly 7, not shown in detail, the connector 8 for the drill bit or drill bits, not shown, and connector 8 has a tail end seal assembly 9 as will be described in greater detail below.

Four pressure control assemblies 10 are located approximately at the mid-point between the connector 8 and the piston mandrel seal assembly 11 which is similarly configured as the tail end seal assembly 9.

The overall arrangement (FIG. 2) including these seal assemblies 9 and 11 includes a rotatable connecting shaft 13 which is threadingly secured with one end at the connector 8 and is threadingly secured with its other end at a rotatable mandrel shaft 14.

Three taper roller bearings 15 are used to journal the connecting shaft 13 for rotation, thereby to rotate the connector 8 with its drill bit or drill bits. The outer sleeves 16 and 17 are stationary.

The assembly is otherwise journalled with a number of needle bearings 18.

Figure 3:
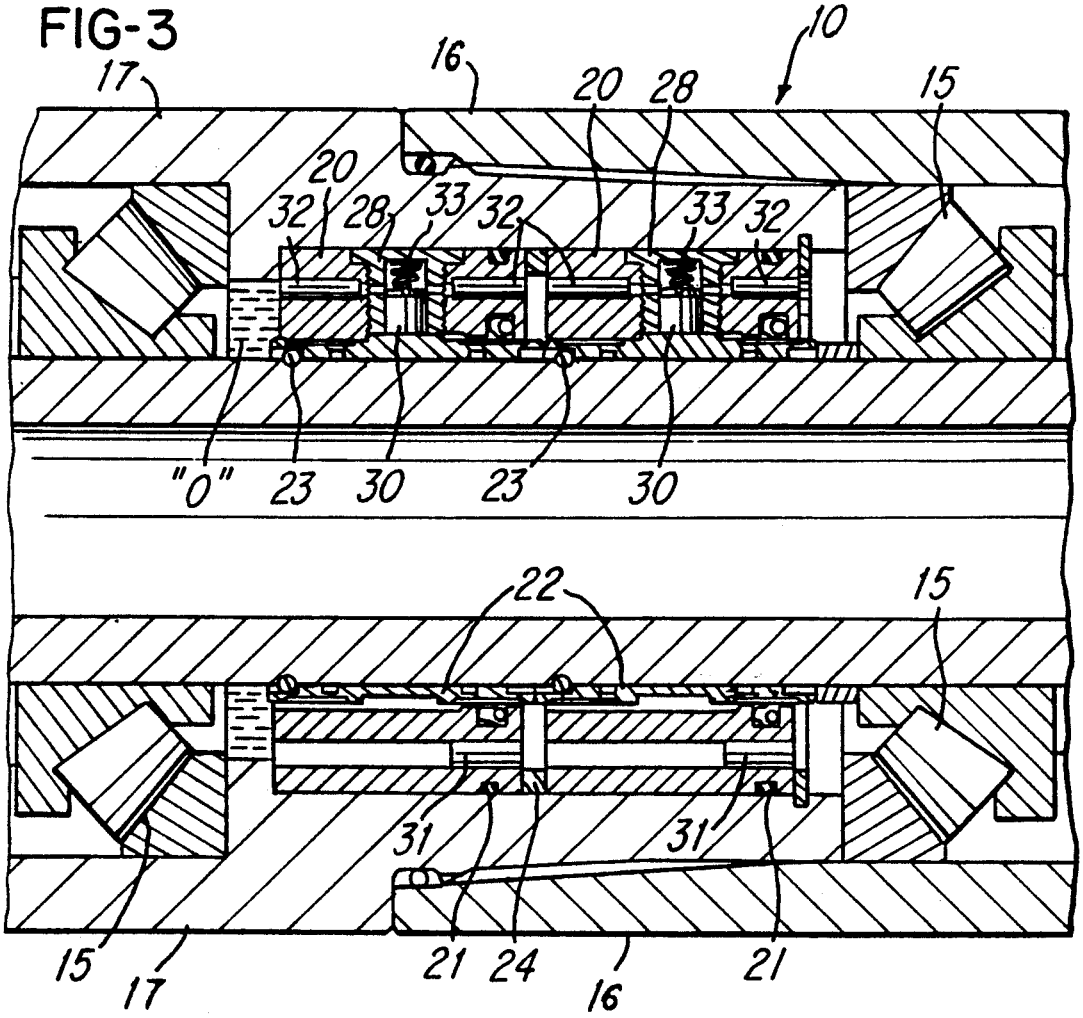
FIG. 3 is a cross-sectional view showing in greater detail a pair of pressure control assemblies.
Figure 4:
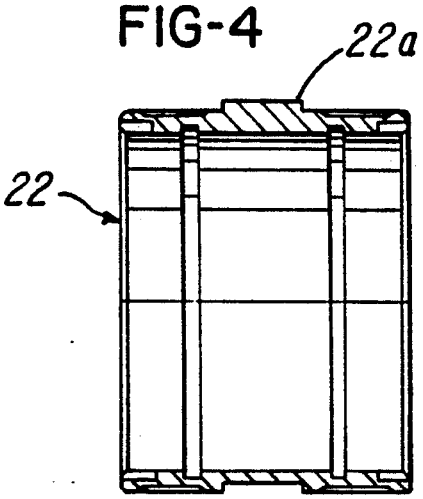
FIG. 4 is a cross-sectional view of an eccentric ring.
Figure 5:
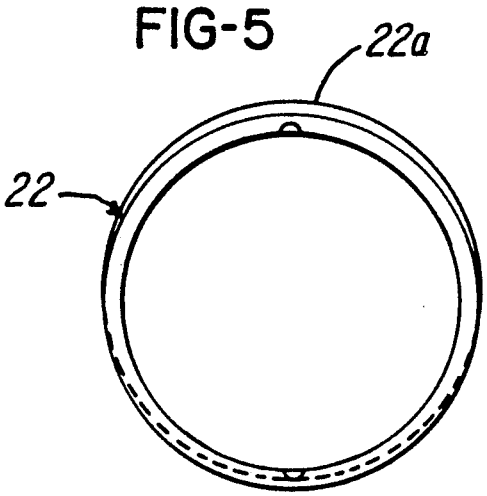
FIG. 5 is an end view of the eccentric ring of FIG. 4.

A first pair of pressure control assemblies 10 is shown in greater detail in FIG. 3. The pair includes two base rings 20 which are secured and sealed in sleeve 16 by way of O-rings 21. The base rings 20, however, have an inner diameter which allows positioning therein of eccentric rings 22, one of which is shown in greater detail in FIGS. 4 and 5. The eccentric rings 22 are secured for rotation therewith at the connecting shaft 13 by spherical retainers 23; and spacer rings 24 separate the two rings 22.

Figure 6:
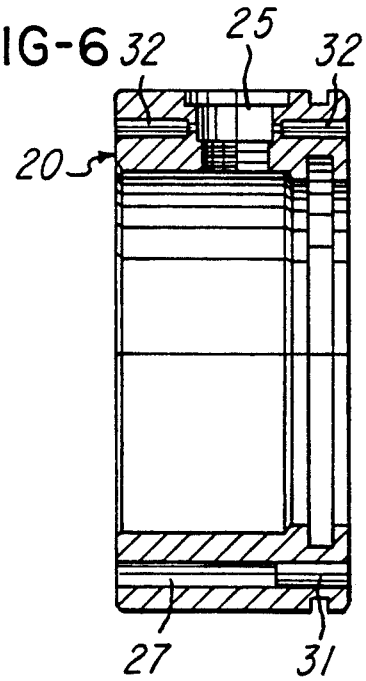
FIG. 6 is a transverse sectional view through the base ring.
Figure 7:
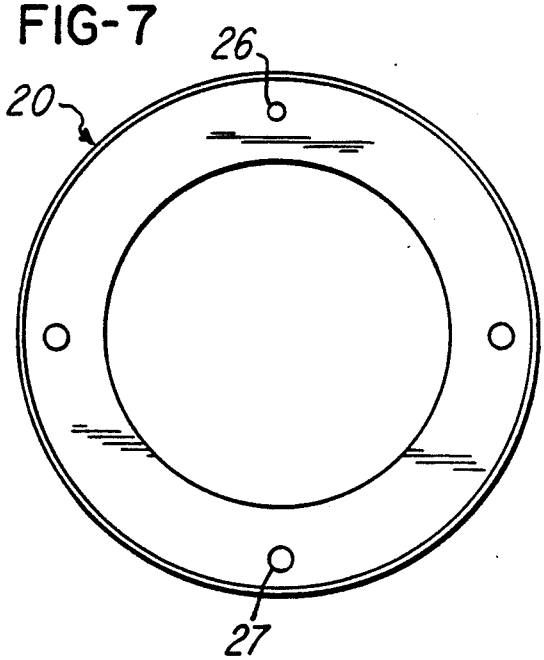
FIG. 7 is an end view of the base ring.
Figure 8:
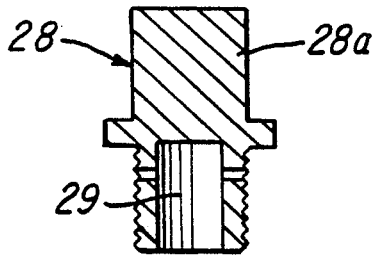
FIG. 8 is a cross-sectional view of the insert for the base ring.
Figure 9:
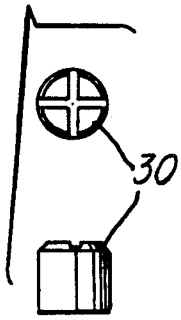
FIG. 9 is a view that shows the piston in elevation and end view.

A base ring 20 is shown in greater detail in FIG. 6. It includes a transverse chamber 25 and longitudinal passages 26 and 27. Transverse chamber 25 receives an insert 28 shown in greater detail in FIG. 8. The insert 28 is threaded into the transverse chamber 25 and its top portion **28*a* is removed to leave a flush cylindrical surface on the base ring 20. The insert 28 has a central piston aperture or chamber 29 which accommodates a piston 30 as can be seen in FIG. 9**.

Figure 10:
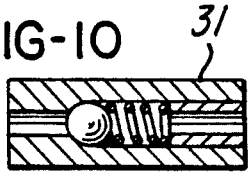
FIG. 10 is a schematic side elevational view of a valve for the base ring.

A valve 31, such as shown schematically in FIG. 10, is positioned in the longitudinal passage 27. Valve 31 is a pressure relief valve. The longitudinal passage 26 at each face of the base ring 20 receives a valve 32, which is similar in structure as to the valve 31 but functions as a pressure control or check valve as will be described in greater detail below. Such check valve 32 can open and close as will also be described.

Lubricating oil "O" is present in the chamber provided between the outer sleeve 16, the connecting shaft 13 and the mandrel shaft 14, as well as the respective seals of the tail end seal assembly 9 and the piston mandrel seal assembly 11.

For operation of a pressure control assembly 10, the piston 30 is reciprocatingly movable in the piston chamber 29 of insert 28, against the force of a spring 33, and upon rotation of the eccentric ring 22, this being secured to rotating connecting shaft 13, the eccentric formation **22*a* (FIG. 5) of the eccentric ring 22 will actuate the piston 30**, with oil "O" being displaced as follows:

With reference to FIG. 3, during the up-stroke of pistons 30, when the left side check valves 32 are closed, oil "O" is expelled from the chambers 29 through the right side check valves 32, so as to move oil "O" from the chamber 29 towards the mandrel or U-joint end of the motor.

During a respective down-stroke of pistons 30, when the right side check valves 32 are closed, oil "O" is introduced into the chambers 29 through the open left side check valves 32.

The pressure relief valves 31 are opened when the oil pressure exerted upon them is greater than their specified rating.

The other two pressure control assemblies 10 are configured and operate in analogous manner.

There is to be understood that the pressure control assemblies 10 can operate in such a way so as to "stage" the pressure which is exerted on the tail end seal assembly 9, with the first pair of pressure control assemblies 10 absorbing, for example, 4137 Kpa (600 psi), i.e., 2068.5 Kpa (300 psi), and the piston mandrel seal assembly 11 absorbing 2758 Kpa (400 psi), i.e., 1379 Kpa (200 psi).

Figure 11:
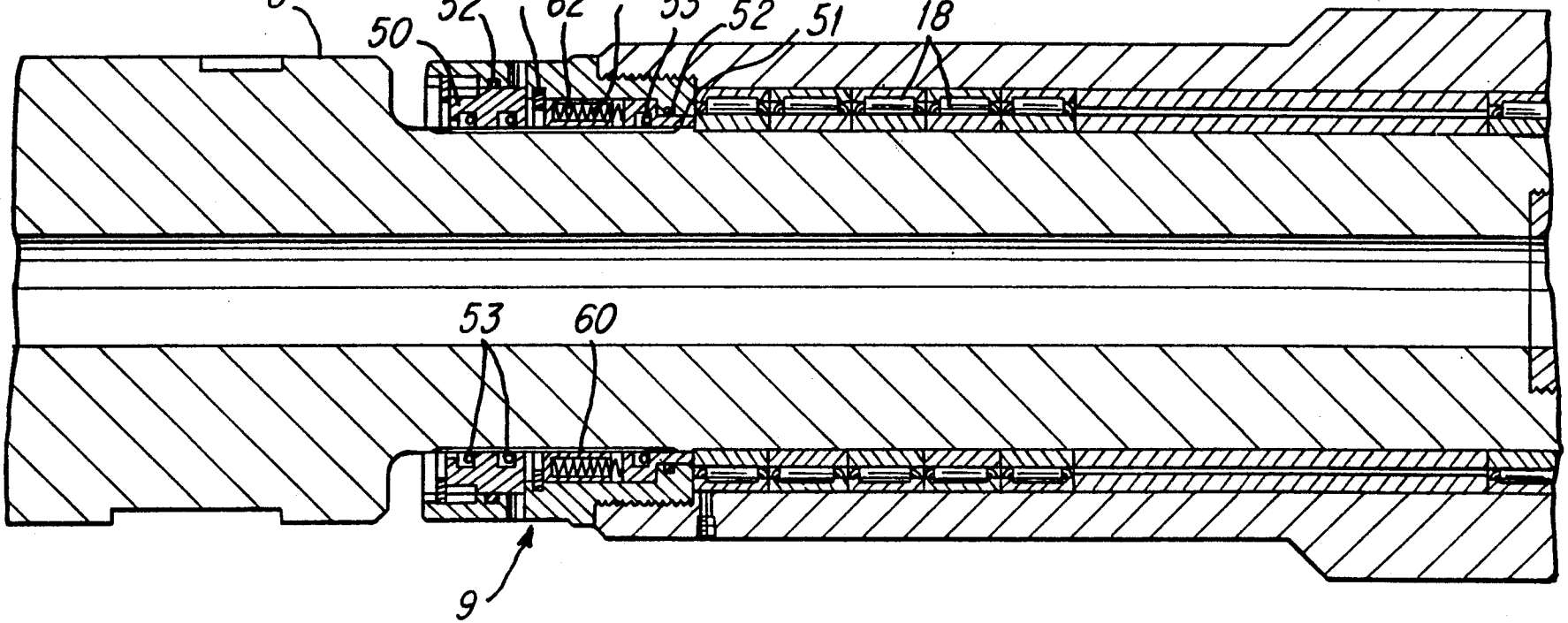
FIG. 11 is a cross-sectional view of the tail end seal assembly.
Figure 12:
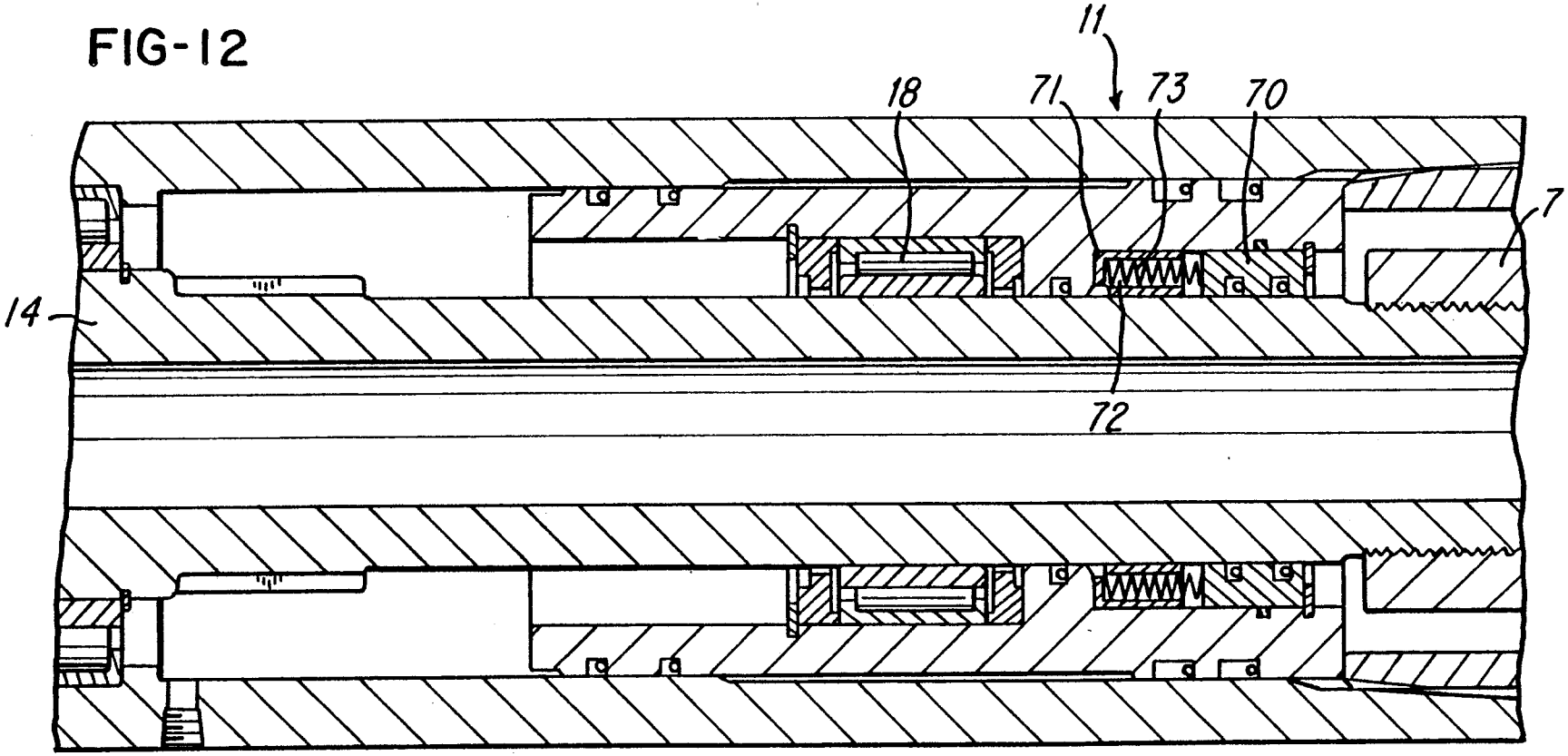
FIG. 12 is a cross-sectional view of the piston mandrel seal assembly.

With particular reference to FIG. 11, the tail end seal assembly 9 includes two seal housing bodies 50 and 51 in which are secured several seal rings (52 and 53), and between the housing bodies 50 and 51 there is arranged a ring 60 secured by a fastener clip 61. This ring 60 has apertures 62 for compressible elements, for example 18 coil springs 63 which contact with one end the housing body 51. As pressure is applied, the sealing effect of the seal rings (52 and 53—which can be POLYPAC-type seal rings) is increased, accordingly.

The piston mandrel seal assembly 11 includes a housing member 70 and a ring 71 with apertures or chambers 72 for supporting compressible elements such as 18 coil springs 73.

It will be understood that the embodiments illustrated in the aforesaid are primarily used for describing the present invention, but not as limiting the present invention. Any structure or apparatus made with or without minor modifications but not deviating from the spirit, concept and features of the present invention is deemed as being included in the scope of the claims of the invention.

What I claim is:

1. A seal and pressure control arrangement for a downhole drilling motor, comprising:

a seal arrangement that includes a first and second seal assembly, at least one of which has a compressible element, wherein an oil-chamber is defined between said first and second seal assemblies and between an outer stationary member and an inner rotating member that is a hollow shaft through which drilling medium is passed under pressure to drill elements; and at least one pressure control assembly, including: at least one pressure relief valve for staging the pressure between said first and second seal assemblies, and a rotary element for displacing a piston that controls at least two check valves.

2. The arrangement according to claim 1, wherein each seal assembly includes at least two seal elements.

3. The arrangement according to claim 1, wherein the operating pressure across said seal arrangement is in excess of approximately 6895 Kpa.

* * * * *